United States Patent [19]

McVey et al.

[11] 4,401,985

[45] Aug. 30, 1983

[54] FULL PAGE DISPLAY APPARATUS FOR TEXT PROCESSING SYSTEM

[75] Inventors: James M. McVey, Florence; Hector G. Romero, Jr.; James D. Wagoner, both of Austin, all of Tex.

[73] Assignee: International Business Machines Corporation, Armonk, N.Y.

[21] Appl. No.: 313,126

[22] Filed: Oct. 20, 1981

[51] Int. Cl.[3] ..... G09G 1/02

[52] U.S. Cl. ..... 340/799; 340/744

[58] Field of Search ..... 340/798, 799, 744

[56] References Cited

U.S. PATENT DOCUMENTS

| | | | |
|---|---|---|---|
| 3,928,845 | 12/1975 | Clark | 340/799 X |
| 4,213,124 | 7/1980 | Barda et al. | 340/798 X |
| 4,249,172 | 2/1981 | Watkins et al. | 340/799 X |
| 4,291,306 | 9/1981 | Kodama et al. | 340/799 X |

*Primary Examiner*—David L. Trafton
*Attorney, Agent, or Firm*—Otto Schmid, Jr.

[57] ABSTRACT

A full page display device for a text processing system in which a text stream input by way of a keyboard is stored and displayed to the operator on a display device including a cathode ray tube, the electron beam of which is modulated and scanned in a series of horizontal traces to produce an image of the text line on the screen of the display device. The system comprises storage means which includes a plurality (four in a specific embodiment) of separate storage devices. In the specific embodiment, when the storage devices are accessed for display, one character is accessed simultaneously from the same location in each of the storage devices. The data is latched and coupled to a character generator to read out character dot pattern data which is latched and then interleaved with the data from other accessed character data by transferring the data one character at a time in parallel to a serializer. The data out of the serializer forms a serial bit stream which is coupled to the cathode ray tube to modulate the intensity of the beam in synchronism with the sweep to display the selected character data.

10 Claims, 9 Drawing Figures

FULL PAGE DISPLAY APPARATUS FOR TEXT PROCESSING SYSTEM

DESCRIPTION

BACKGROUND OF THE INVENTION

This invention relates in general to a display device for an interactive text processing system and more particularly to an improved high density display for a text processing system which is capable of displaying a full page.

DESCRIPTION OF THE PRIOR ART

Prior art interactive text processing systems have utilized display devices capable of displaying about 2000 characters. These display devices utilize cathode ray tubes (CRTs), standard raster scan techniques, and standard CRT controllers. These display devices are relatively inexpensive and possess other operational characteristics which make them suitable for use in an interactive text processing system.

As text processing technology has advanced, there has developed the need for a display device to display a full page image. The full page image requires the display of a significantly larger number of characters. There is a critical trade-off between cost and speed of operation in both CRT controllers and in memory circuits. The speed of the logic and memory circuits required to operate a full page display of the type described here is sufficiently high so that no standard CRT controller is available which is suitable for this application. The use of a custom designed controller raises the cost still further to the point that the full page display in an interactive text processing system cannot be economically justified.

SUMMARY OF THE INVENTION

It is accordingly an object of the present invention to provide an improved display device for an interactive text processing system suitable for displaying a full page.

It is a further object of the present invention to provide a display device operable with a standard CRT controller to display a full page in an interactive text processing system.

These and other objects and advantages are achieved with the present display apparatus. Briefly, there is provided a text processing system in which a text stream input by way of a keyboard is stored and displayed to an operator on a display device comprising a cathode ray tube and an electron beam which is modulated and scanned in a series of horizontal traces to produce an image of the text data on the screen of the display device. The system comprises storage means which includes a plurality of separate storage devices and, as the text data is entered into the system, the text data is stored in a format in which successive characters of the text data are each stored in separate ones of the storage devices. When the stored data is accessed for display on the display device, a plurality of characters are accessed simultaneously from selected ones of the storage devices and this data is temporarily stored so that the selected character data can be interleaved and serialized to form a serial bit stream which is coupled to control the intensity of the electron beam in synchronism with the horizontal traces to achieve the successive text line displays on the screen, each text line display including a plurality of successive horizontal traces.

In a specific embodiment, four storage devices are provided so that each set of four characters of the text data being entered is stored with one character in the corresponding location of each of the four storage devices. In accessing the data to be displayed, four characters are accessed simultaneously, one from the addressed location of each of the storage devices. The accessed data is temporarily stored in latch means so that each of the characters can then be interleaved and serialized to form the serial bit stream of text data.

DESCRIPTION OF THE INVENTION

Figure 1:
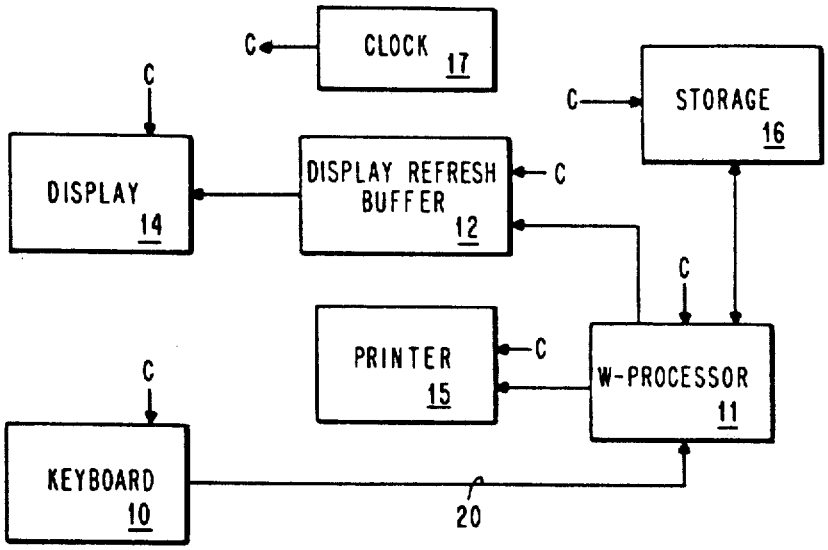
FIG. 1 is a block diagram of an interactive text processing system embodying the present invention.

The invention will now be described as embodied in an interactive text processing system of the type shown in FIG. 1. As shown in FIG. 1, the text processing system illustrated therein comprises a keyboard 10, a microprocessor 11, a display refresh buffer 12, a display device 14, a printer 15, and an auxiliary diskette storage device 16. A clock 17, for keeping the various components of the system in synchronism, is also shown in FIG. 1 and is effectively coupled to each of the units.

Keyboard 10 comprises a normal set of graphic symbol keys such as letters, numbers, punctuation marks, and special character keys, plus text format or control keys like carriage return, indent, etc. In addition, the keyboard includes a second set of control keys for issuing special control commands to the system. The control keys include cursor movement keys, keys for setting the keyboard into a number of different modes, etc.

Figure 2:
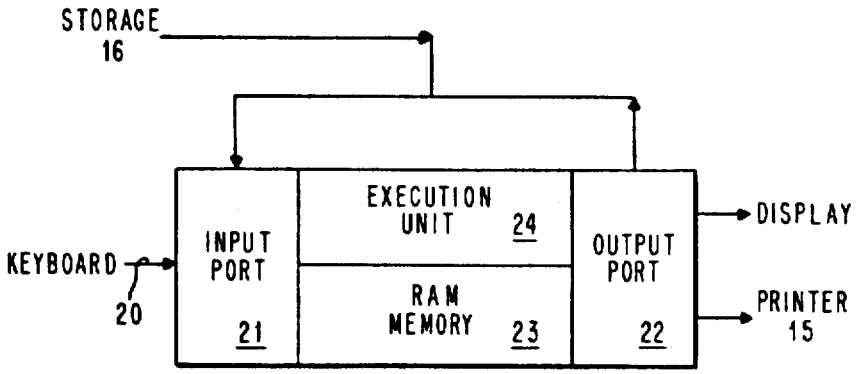
FIG. 2 is a functional diagram of the microprocessor shown in FIG. 1.

The keyboard is connected to the microprocessor by means of a bus 20. The microprocessor, as shown in FIG. 2, comprises an input port 21, an output port 22, a random access memory 23, and a process execution unit 24.

Figure 3:
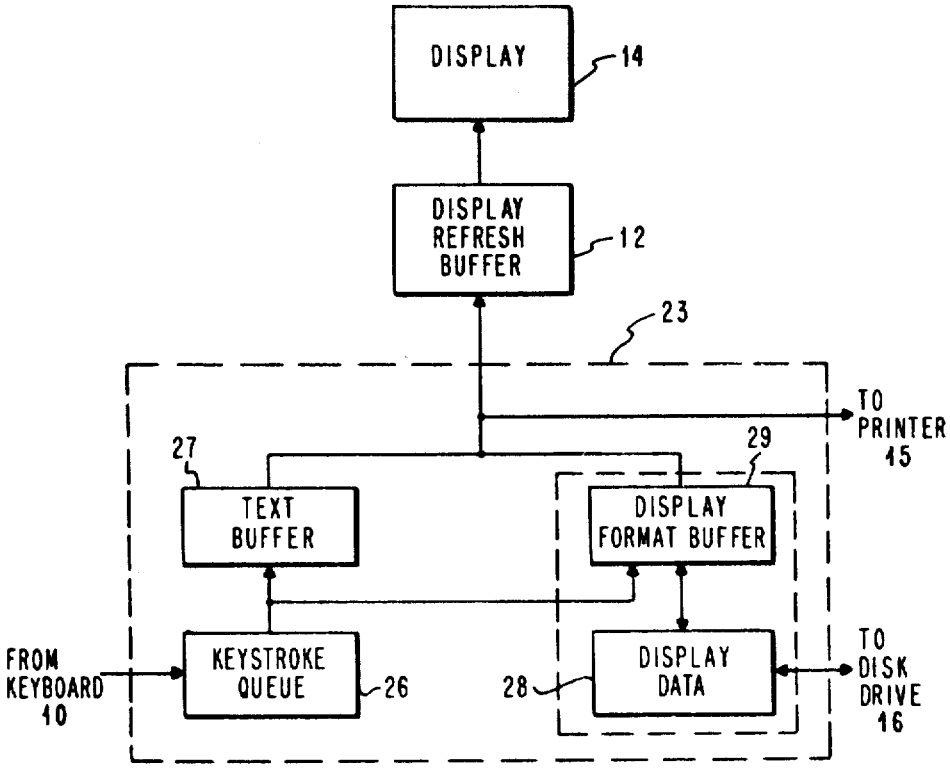
FIG. 3 is a functional diagram illustrating the data flow path between portions of the memory and the microprocessor and the display refresh buffer.

Functionally, memory unit 23 stores both instructions and data in specified sections which will be described in more detail later on in the specification. Data is entered into memory 23 from the keyboard as bytes of binary information through input port 21. As shown in FIG. 3, the section of RAM 23 which receives the keystroke data from the keyboard is designated keystroke queue 26. Data to be displayed is transferred by a series of instructions from queue 26 to the text buffer section 27 and then to the display refresh buffer 12 through output port 22 of the microprocessor 11. This is achieved in a conventional way by the microprocessor executing a series of move instructions.

The microprocessor 11 may be an IBM Series 1, an INTEL model 8086 or any of the recognized functionally equivalent, currently available microprocessors.

The display refresh buffer 12 is shown as a separate buffer connected between the output port 22 and the display device 14. Buffer 12, in practice, is normally a part of the display device 14 and functions to control the generation of characters on the screen of the display device 14 by exercising on-off control of the beam as it traces a series of horizontal lines across the screen.

The output port 22 also supplies data stored in memory 23 to the printer 15 and diskette storge unit 16, each of which may have their own internal buffers which are not shown. Commands to transfer data from the random access memory 23 to the printer 15 or storage unit 16 are sent to the microprocessor 11 by the operator from the keyboard 10.

Printer 15 may be any suitable printer known in the art. In most text processing systems, the printer is basically a standard input/output terminal printer having a type ball element or a daisy-wheel print element.

Diskette storage 16 may also be any suitable disk storage device which is capable of storing serial by byte data supplied to it at determined sector address locations, each of which are randomly addressable by the microprocessor to retrieve the data. Spatially related data supplied to diskette drive 16 is stored in the display data area 28 of the memory 23 in encoded form. The other section of memory 23 shown in FIG. 3 is the display format buffer area 29 which is involved in the handling of spatially related data in decoded form.

Figure 4:
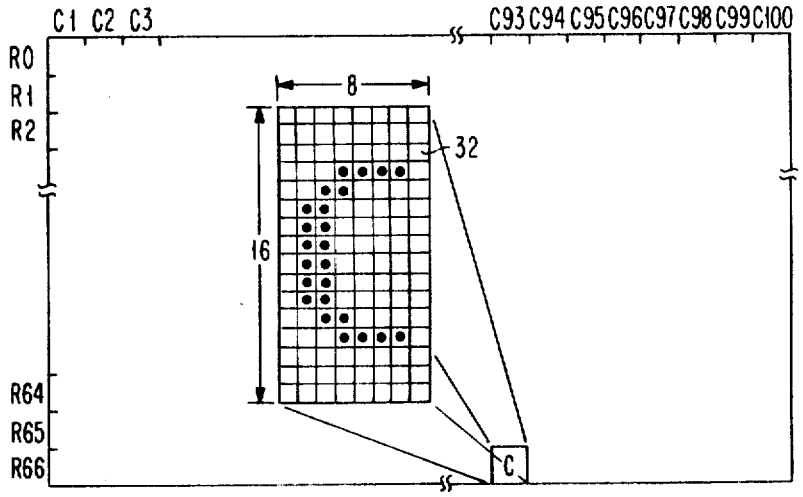
FIG. 4 is a diagrammatic view of the display in FIG. 1.

FIG. 4 is a schematic representation of the screen of display device 14. As shown in FIG. 4, the screen has, for example, the capability of displaying 66 lines of characters where each line consists of 100 character column positions. In practice, one character position consists of a matrix of dot positions or picture elements sometimes referred to as pels. A typical character matrix for a display of the type represented by device 14 would be a matrix of eight wide by sixteen high pels, which has been designated by reference character 32 in FIG. 4. The interaction of the refresh buffer 12 and the display 14 is to convert the characters stored at a location in the buffer 12 to the corresponding character as formed in an $8 \times 16$ dot matrix at the equivalent location on the display 14. Display 14 generally is provided with its own set of electronics to achieve that conversion. The microprocessor 11 need only supply the address and load the buffer 12 with the appropriate characters.

The diskette storage device 16 also is generally provided with its own set of electronics for converting a byte of data supplied from the display data area 28 of memory 23 through the output port 22 to a serial by bit stream of data to be recorded at a predetermined sector of the one addressed concentric recording track on the diskette. Data from the device 16 is supplied to the microprocessor 11 serial by byte from the addressed sector and storage tracks when requested.

It will be understood that all of the above described functions and interactions involving the microprocessor 11 are achieved through suitable programs which are also stored in memory 23 and which are called into operation in response to data from the keyboard 10 or interrupt signals generated by the various components of the system shown in FIG. 1.

Figure 5:
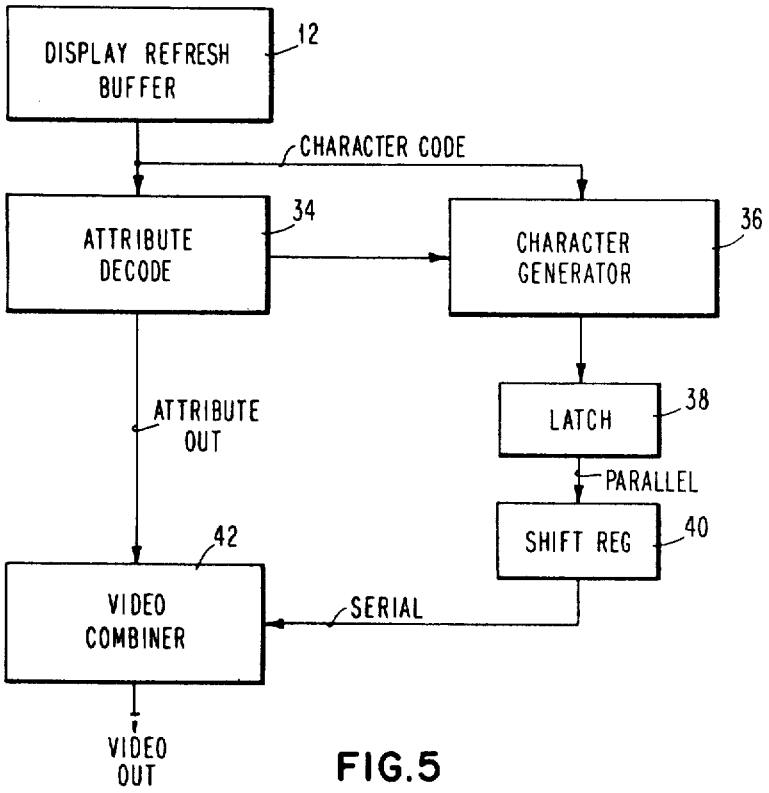
FIG. 5 is a functional diagram of the general data flow path between the refresh buffer and the serial bit stream of text data to the CRT of the display shown in FIG. 1.

FIG. 5 shows the general data flow in display device 14 from the display refresh buffer 12. The data to be displayed includes character (CHAR) and attribute (ATT) information (TEXT) which is stored in display refresh buffer 12 by microprocessor 11 through the dual ported memory interface. The text is fetched by the display logic circuits as a group (byte) of character data and a group (byte) of attribute data. The attribute data for each character is decoded in the attribute decode logic 34 and used along with the scan line address data supplied by the display logic circuits in addressing the character generator 36.

Character generator 36 stores data for all characters in the font in dot matrix format. In the specific embodiment illustrated in FIG. 4, each character is formed in a character box which is eight matrix positions wide and sixteen positions high. Characters are produced in visual form on the display screen in a series of successive horizontal traces (scan lines). Each horizontal trace produces the corresponding one of the sixteen horizontal slices of each character on that text line so a total of sixteen horizontal traces is required to display one line of text.

Character font data read out of the character generator is coupled to latch means 38 and latched so that it can be loaded into a parallel to serial converter such as shift register 40 at the correct character interval. The character data is shifted out of shift register 40 serially and the serial character data out of the shift register is synchronized with the corresponding attribute data for that character from attribute logic circuits 34 in video combiner 42 to provide the video input to the CRT.

As previously stated above, there is a critical tradeoff between cost and speed of operation in both CRT controllers and in memory circuits. It was also pointed out above that no standard CRT controller is available to meet the requirements for display of a full page. However, by utilizing a modified control architecture whereby multiple characters are fetched, each from a separate storage device, a standard CRT controller can be utilized to display a full page text image. Slower speed memory (and, therefore, less expensive) is required to implement this modified control architecture thereby leading to a display device which makes it economically feasible to display a full page text image in an interactive text processing system.

This architecture is implemented in the specific embodiment shown in the drawings in which four characters are fetched for each cycle of the CRT controller. This operation has the effect of letting the CRT controller run at one-quarter the rate that would be required for a conventional full page display. The multiple character data is interleaved prior to actual display to produce a bit stream of text data at the full data rate so that a full page display can be produced.

Figure 6:
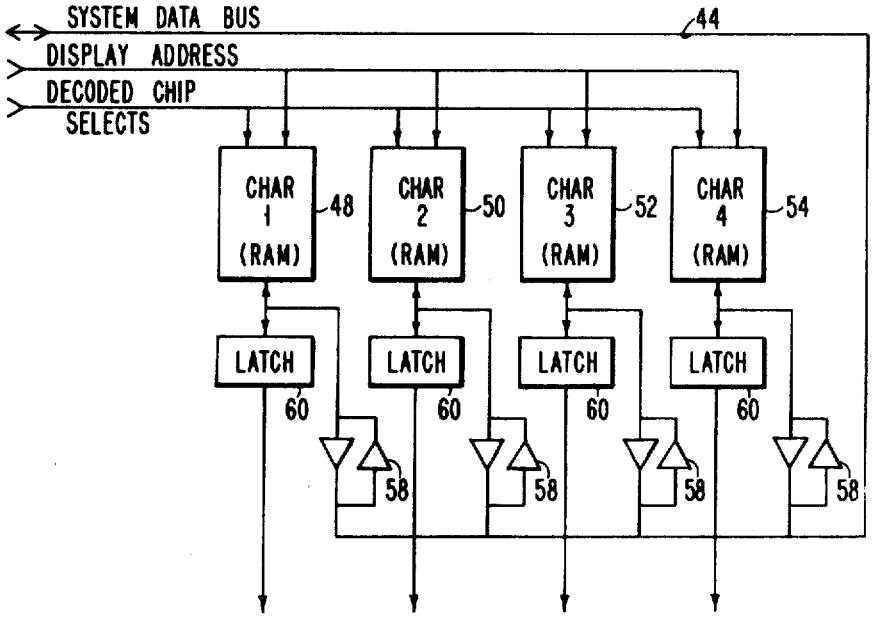
FIG. 6 is a functional block diagram of a specific embodiment of the data flow path shown in FIG. 5.
Figure 7:
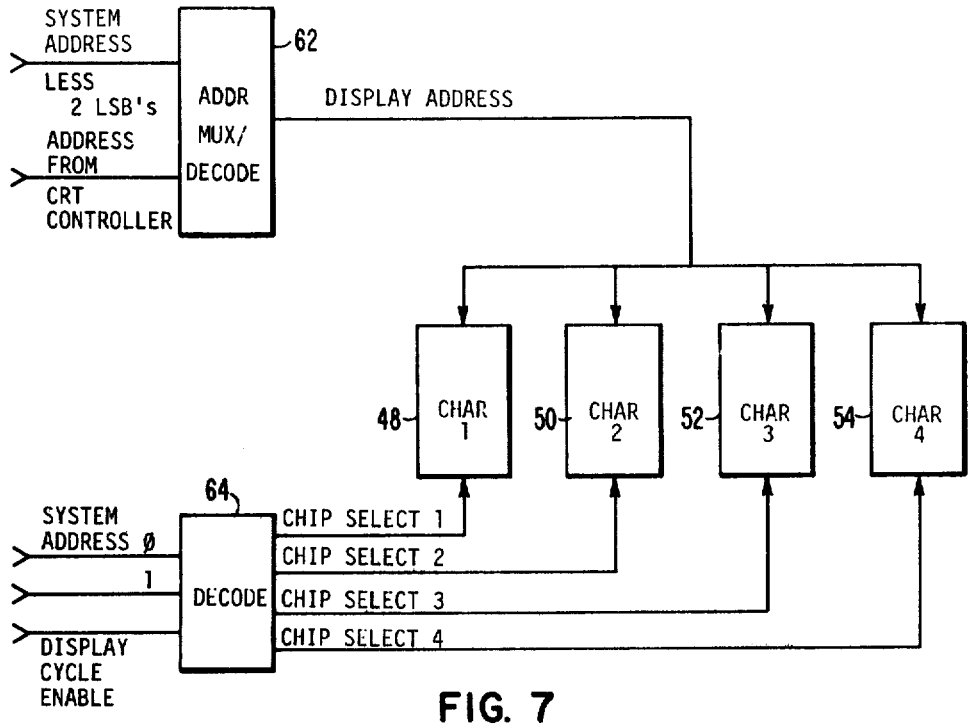
FIG. 7 is a functional block diagram of the addressing means for the character display buffers shown in FIG. 6.
Figure 9:
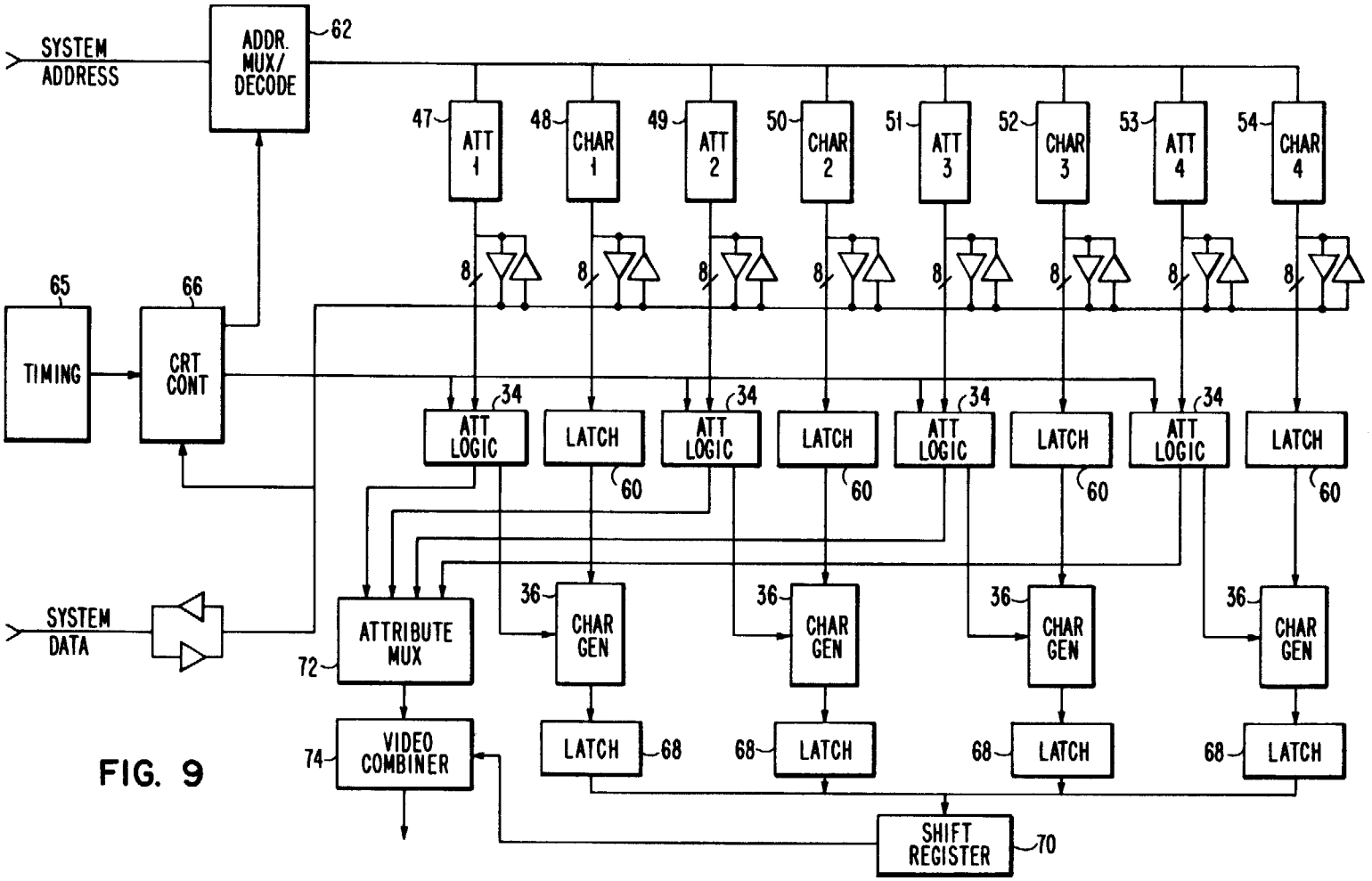
FIG. 9 is a functional block diagram of the data flow path in greater detail for the specific embodiment of the apparatus shown in FIGS. 6 and 7.

The data to be displayed is entered over system data bus 44 (FIG. 6) to display refresh buffers 48, 50, 52, 54 under control of tri-state devices 56. Alternatively, data read out from display buffers 48, 50, 52, 54 can be coupled to system data bus 44 under control of tri-state devices 58 and, in addition to or alternatively, the data can be set into latch means 60 which provide a means to temporarily store the data. The address signals to store data into the display buffer are generated in the system and transmitted to the display device. All the address bits from the system except for the two low order bits are coupled to address multiplexer 62 (FIG. 7). The two low order bits are coupled to chip decode circuit 64. The two bits are decoded into four signals CHIP SELECT 1, CHIP SELECT 2, CHIP SELECT 3 and CHIP SELECT 4. The chip select signals thus select the one of display buffers 48, 50, 52, 54 corresponding to the address sent from the system. The remaining address bits from multiplexer 62 designate the position in the selected buffer at which the data is stored. It can be seen that four successive addresses sent by the system to store a set of four characters will result in one byte being stored in each of buffers 48, 50, 52, 54 at the location defined by the address bit other than the two low order bits. As shown in FIG. 9, the attribute (ATT) bytes are also stored in successive attribute buffers 47, 49, 51, 53 in the same manner.

When data is to be displayed, the address is generated in conventional fashion by the CRT controller and coupled as an input to address multiplexer circuit 62. At the same time, a signal DISPLAY CYCLE ENABLE is generated and coupled as one input to chip decode circuit 64. The signal DISPLAY CYCLE ENABLE makes active each of the chip select signals CHIP SELECT 1, CHIP SELECT 2, CHIP SELECT 3, and CHIP SELECT 4 so that each of buffers 48, 50, 52, and 54 are selected for a display cycle. The address from the CRT controller is coupled to each of the buffers to read out the byte at that address in each of the buffers. In a display cycle this byte is latched in latch means 60 so that the data to be displayed will be available for use after the storage access cycle for the display cycle is completed. The display buffers can then be accessed, if desired, concurrently with subsequent operations with the display data now temporarily stored in latches 60.

Figure 8:
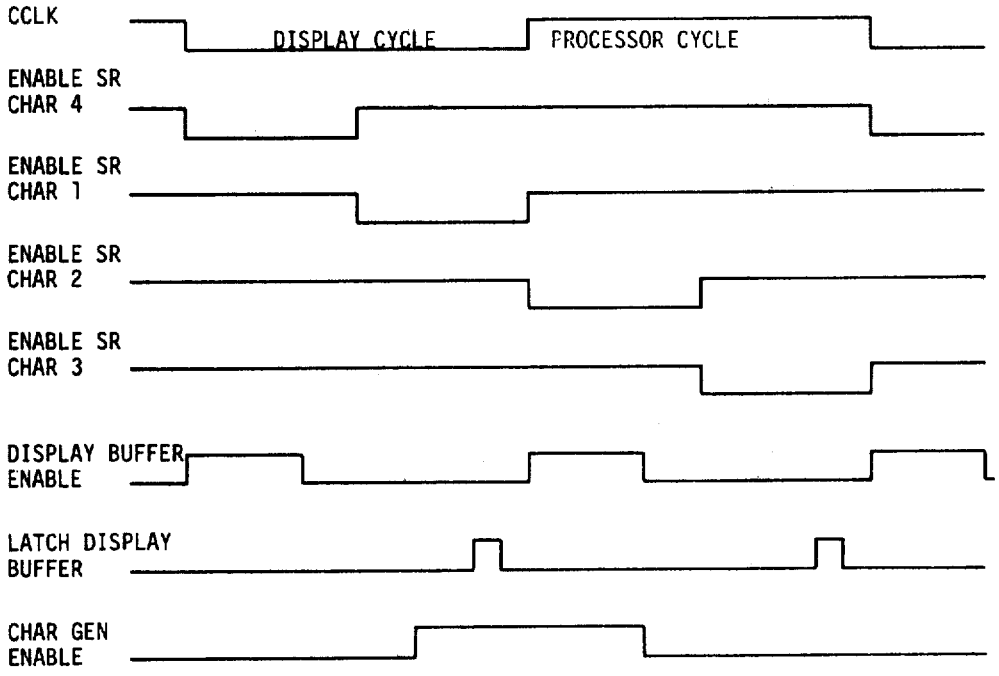
FIG. 8 is a timing diagram showing the relative timing of the fetch and latching of character data from the character display buffers shown in FIG. 7.

The relative timing for the data accessing operations of the display device are shown in FIG. 8. Clock 17 provides the basic timing for the text processing system including the address signals sent to the display device. The display device also has timing means 65 which provides timing signals to control various operations within display device 14. Timing means 65 comprises a very stable clock at a high frequency corresponding to the bit rate required to produce the display. Timing means 65 also includes various dividers to produce clock signal outputs at the rates required for the CRT controller 66 and various operations required to be executed in the display operation. The CRT controller 66 controls the timing for all display functions including all deflection circuits, control circuits and data transfer circuits. The CCLK signal is one of the timing signals derived from the display timing means 67 and this signal is used to coordinate references to the display buffers between the system and the display device. The DISPLAY DEVICE part of the CCLK signal enables a reference to the display buffers by the display device 14 and the PROCESSOR CYCLE part of the CCLK signal enables access by microprocessor 11 to store data or read some status information in the display buffers. This timing permits the display device to operate synchronously with the system for data accesses to the display buffers and asynchronously with the system for all other operations.

The timing for the display device includes the signal DISPLAY BUFFER ENABLE in which the down level of this signal enables data to be read out in the DISPLAY CYCLE and read in during the PROCESSOR CYCLE. The data accessed in the appropriate cycle is latched in latch means 60 in response to the signal LATCH DISPLAY BUFFER, the up level of which is effective to cause the data to be latched. The up level of the signal CHAR GEN ENABLE enables the appropriate character generator 36 to be accessed by the latched character from the display buffer. This signal, along with a signal from the attribute logic circuits 34, determines the character dot pattern to be read out and latched in latch means 68. The signal from attribute logic means 34 results from accessing concurrently with the four bytes of display data (CHAR) from display buffers 48, 50, 52, and 54 the corresponding attribute (ATT) bytes from display buffers 47, 49, 51 and 53. The attribute bytes are decoded in attribute logic circuits 34 to generate, if required, a signal to the corresponding character generator 36. In addition, the attribute bytes are coupled to attribute multiplexer 72.

The down level of signals ENABLE SR CHAR 1, ENABLE SR CHAR 2, ENABLE SR CHAR 3, and ENABLE SR CHAR 4 are effective to interleave the four characters accessed from the display buffers. These signals are successively effective during one cycle of the CCLK signal, and ENABLE SR CHAR 1 is down (effective) during the time that the four characters are accessed and latched. Conversely, ENABLE SR CHAR 4 is effective prior to the time the characters are latched so the character 4 accessed is the fourth character from the previous fetch. The ENABLE SR CHAR 1 to 4 signals are sequentially effective to load the latched character from latch means 68 in parallel into shift register 70. A similar set of signals (not shown) are effective to load the appropriate attribute byte into attribute multiplexer 72. A clock signal at the display bit rate from timing means 65 is utilized to read out the data from shift register 70 serially and couple the data to video combiner 74 to which the appropriate attribute data is also coupled. The serial bit stream of data to be displayed is coupled out of video combiner 74 and utilized to control the intensity of the electron beam of the cathode ray tube in synchronism with the horizontal traces to achieve successive text line displays on the screen, each test line including 16 successive horizontal traces in the character configuration shown in FIG. 4.

While the invention has been shown and described with reference to a preferred embodiment thereof, it will be understood by those skilled in the art that various other changes in the form and details may be made therein without departing from the spirit and scope of the invention.

Having thus described our invention, what we claim as new and desire to secure by Letters Patent is:

1. In an interactive text processing system in which a text stream input by way of a keyboard is stored and displayed to an operator, on a display device comprising a cathode ray tube and an electron beam which is modulated and scanned in a series of horizontal scans to produce an image of said text data on the screen of said display device, the combination which comprises:

storage means including a plurality of separate storage devices;

means for entering text data into said system in a format in which successive characters of said text data are each stored in separate ones of said separate storage devices;

means for accessing selected text data to be displayed from said stored text data in a format in which multiple characters are simultaneously read out from selected ones of said storage devices;

means for cyclically receiving and temporarily storing said selected text data from said storage devices;

means for interleaving and serializing said selected text data to form a serial data stream of said selected text data; and means for coupling said serial data stream to control the intensity of said electron beam in synchronism with said horizontal traces to achieve successive text line displays on said screen, each text line display including a plurality of successive horizontal traces.

2. The text processing system recited in claim 1 in which said means for entering text data into said system includes addressing means for simultaneously accessing one character at the same location in each of said storage devices.

3. The text processing system recited in claim 1 additionally including a character generator for receiving said selected text data from said storage devices prior to temporarily storing said data.

4. The text processing system recited in claim 3 in which said means for temporarily storing said selected text data comprises latch means.

5. The text processing system recited in claim 1 additionally comprising serializer means and wherein said means for interleaving and serializing said selected text data comprises means responsive to a first series of timing signals to transfer said selected text data in parallel, one character at a time, to said serializer means, and said serializer means operable in response to a second series of timing signals to produce said serial data stream.

6. The text processing system recited in claim 1 in which said storage means comprises four separate storage devices.

7. The text processing system recited in claim 6 in which said means for entering text data into said system includes addressing means for simultaneously accessing one character at the same location in each of said storage devices.

8. The text processing system recited in claim 6 additionally including a character generator for receiving said selected text data from said storage devices prior to temporarily storing said data.

9. The text processing system recited in claim 8 in which said means for temporarily storing said selected text data comprises latch means.

10. The text processing system recited in claim 6 additionally comprising serializer means and means for interleaving and serializing said selected text data comprises means responsive to a first series of timing signals to transfer said selected text data in parallel, one character at a time, to said serializer means, and said serializer means operable in response to a second series of timing signals to produce said serial data stream.

* * * * *